US011351693B1

(12) United States Patent
Karas

(10) Patent No.: US 11,351,693 B1
(45) Date of Patent: Jun. 7, 2022

(54) SLICER BLADE GUIDE WITH WEAR INSERT

(71) Applicant: Richard Karas, Algonquin, IL (US)

(72) Inventor: Richard Karas, Algonquin, IL (US)

( * ) Notice: Subject to any disclaimer, the term of this patent is extended or adjusted under 35 U.S.C. 154(b) by 0 days.

(21) Appl. No.: 17/010,925

(22) Filed: Sep. 3, 2020

(51) Int. Cl.
*B26D 7/00* (2006.01)
*B26D 1/00* (2006.01)

(52) U.S. Cl.
CPC ..... *B26D 7/0006* (2013.01); *B26D 1/0006* (2013.01); *B26D 2210/02* (2013.01)

(58) Field of Classification Search
CPC ..... B26D 1/0006; B26D 1/54; B26D 1/46; B26D 2210/02; B26D 3/005; B26D 3/28; B26D 7/0006; Y10T 83/7264; Y10T 83/6544; Y10T 83/6553; Y10T 83/6492; B23D 55/082
USPC ..... 83/820, 102.1, 871, 874; 144/182; 69/9, 69/10, 21.5
See application file for complete search history.

(56) References Cited

U.S. PATENT DOCUMENTS 2,670,768 A * 3/1954 Yohn ..... B27L 5/06 83/102.1
2,790,339 A * 4/1957 Brink ..... A21C 11/10 76/82
3,435,640 A * 4/1969 Flekac ..... C14B 1/14 69/10
3,530,752 A * 9/1970 Aizawa ..... B23D 55/082 83/820
3,530,753 A * 9/1970 Imai ..... B65H 20/04 83/436.7
3,534,647 A * 10/1970 Mills ..... B27B 13/10 83/820
3,537,340 A * 11/1970 Westbrook ..... B23D 55/082 82/117
3,848,493 A * 11/1974 Harris ..... B23D 55/082 83/820
4,014,235 A * 3/1977 Fukami ..... B23D 55/082 83/565
4,230,007 A * 10/1980 Grote ..... B26D 1/0006 83/409.2
4,258,601 A * 3/1981 Tanabe ..... B23D 55/082 83/820
4,290,330 A * 9/1981 Washio ..... B23D 55/082 83/171

(Continued)

FOREIGN PATENT DOCUMENTS

GB 277677 A * 1/1928 ..... B26D 3/005

*Primary Examiner* — Laura M Lee
(74) *Attorney, Agent, or Firm* — Donald J. Ersler

(57) ABSTRACT

A slicer blade guide with insert preferably includes a base guide plate, an upper guide plate, at least one blade insert and a pair end caps. The base guide plate preferably includes a base angled blade surface, a base insert slot and a bottom chamfered surface. The base angled blade surface extends upward from a top surface of the base guide plate. A bottom of the at least one blade insert is retained in the base insert slot and axially retained with the pair end caps. The upper guide plate preferably includes an upper angled blade surface and an upper insert slot. The upper angled blade surface extends upward from a bottom surface of the upper guide plate. A top of the at least one blade insert is retained in the upper insert slot. The upper guide plate is secured to the base guide plate with a plurality of fasteners.

18 Claims, 3 Drawing Sheets

(56) References Cited

U.S. PATENT DOCUMENTS

| | | | | | |
|---|---|---|---|---|---|
| 4,327,621 | A * | 5/1982 | Voorhees | B23D 55/084 | 83/820 |
| 4,498,360 | A * | 2/1985 | Milum | B24D 15/06 | 30/283 |
| 5,375,492 | A * | 12/1994 | Smitterberg | B26D 7/32 | 83/13 |
| 5,660,095 | A * | 8/1997 | Smitterberg | B26D 1/02 | 83/74 |
| 6,269,724 | B1 * | 8/2001 | Sabatelli | B26D 3/008 | 83/788 |
| 6,889,589 | B1 * | 5/2005 | Belfiglio | B23D 55/082 | 83/820 |
| 9,289,837 | B2 * | 3/2016 | Tokiwa | B23D 55/082 | |
| 2005/0109184 | A1 * | 5/2005 | Belfiglio | B23D 55/082 | 83/820 |
| 2012/0204700 | A1 * | 8/2012 | Tokiwa | B23D 55/082 | 83/820 |
| 2018/0169776 | A1 * | 6/2018 | Chiao | B23D 59/001 | |
| 2019/0283156 | A1 * | 9/2019 | Ewers | B23D 55/082 | |

* cited by examiner

SLICER BLADE GUIDE WITH WEAR INSERT

BACKGROUND OF THE INVENTION

1. Field of the Invention

The present invention relates generally to food processing machinery and more specifically to a slicer blade guide with insert, which reduces the amount of maintenance required for a food slicing machine and increases longevity of the machine.

2. Discussion of the Prior Art

Slicer blade guides provide support for a continuous cutting blade used in a food slicing machine. However, the slicer blade guide must be replaced about every 4-6 weeks, because of wear. The slicer blade guide needs to be replaced and the machine needs to be recalibrated. The above maintenance requires two workers, which both work at least eight hours. Applicant's invention need only be replaced once a every year instead of every month. Reduced maintenance results in less down time for the food slicing machine and thus greater machine productivity.

Accordingly, there is a clearly felt need in the art for a slicer blade guide with insert, which reduces the amount of maintenance required for replacing the slicer blade guide on a food slicing machine and increases longevity of the machine.

SUMMARY OF THE INVENTION

The present invention provides a slicer blade guide with insert, which reduces the amount of maintenance required for a food slicing machine. The slicer blade guide with insert (slicer blade guide) preferably includes a base guide plate, an upper guide plate, at least one blade insert and a pair end caps. The base guide plate preferably includes a base angled blade surface, a base insert slot and a bottom chamfered surface. The base angled blade surface, the base insert slot and the bottom chamfered surface extend across a length of the base guide plate. The base angled blade surface extends upward from a top surface of the base guide plate at a front thereof and forms an acute angle with a top surface of the base guide plate. A bottom of the base insert slot is preferably parallel to the base angled blade surface. The base angled blade surface has a width that is less than a width of a cutting blade. The base angled blade surface is coated to resist wear from the cutting blade. The coating is preferably chrome, but other coatings may also be used. A bottom of the at least one blade insert is retained in the base insert slot and preferably axially retained on each end with the pair end caps. The at least one blade insert is preferably fabricated from carbide, but other materials may also be used. The at least one blade insert may be purchased from numerous vendors.

The upper guide plate preferably includes an upper angled blade surface and an upper insert slot. The upper angled blade surface and the upper insert slot extend across a length of the upper guide plate. The upper angled blade surface extends upward from a bottom surface of the upper guide plate and forms an acute angle therewith. A top of the upper insert slot is parallel to the upper angled blade surface. The upper angled blade surface is parallel to the base angled blade surface. The upper angled blade surface has a width that is less than a width of a cutting blade. A cutting edge of the cutting blade must extend beyond the slicer blade guide to cut. The upper angled blade surface is coated to resist wear. The coating is preferably chrome, but other coatings may also be used. A top of the at least one blade insert is retained in the upper insert slot. The upper guide plate is secured to the base guide plate with a plurality of fasteners. When the upper guide plate is secured to the base guide plate a distance between the upper angled blade surface and the lower angled blade surface is slightly greater than a thickness of the slicing blade.

Accordingly, it is an object of the present invention to provide a slicer blade guide, which reduces the amount of maintenance required for replacing the slicer blade guide on a food slicing machine and increases longevity of the machine.

These and additional objects, advantages, features and benefits of the present invention will become apparent from the following specification.

DETAILED DESCRIPTION OF THE PREFERRED EMBODIMENTS

Figure 1:
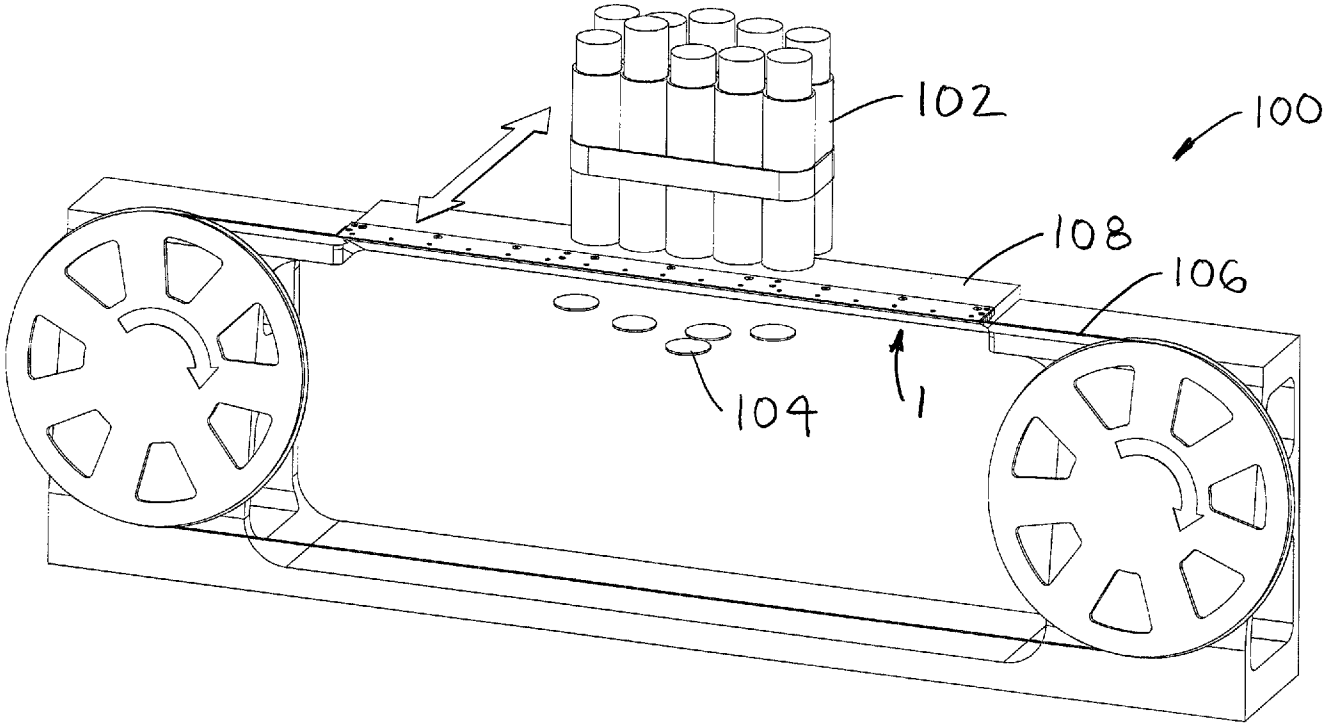
FIG. 1 is a perspective view of a portion of a food slicing machine with a slicer blade guide installed in the food slicing machine in accordance with the present invention.
Figure 4:
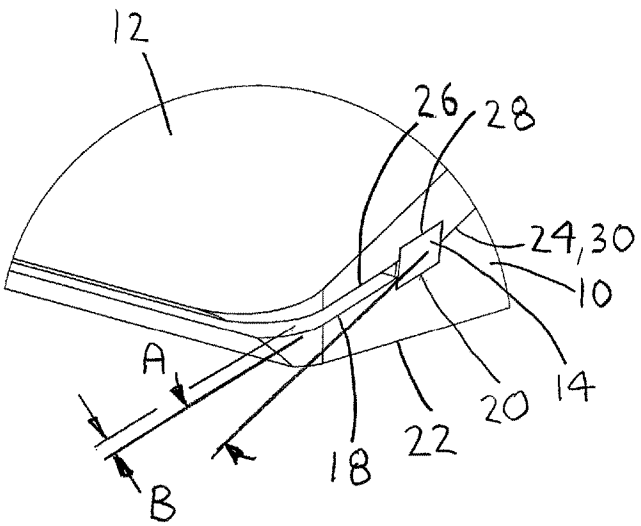
FIG. 4 is an enlarged perspective view of an end of an assembled slicer blade guide of FIG. 3 in accordance with the present invention.
Figure 3:
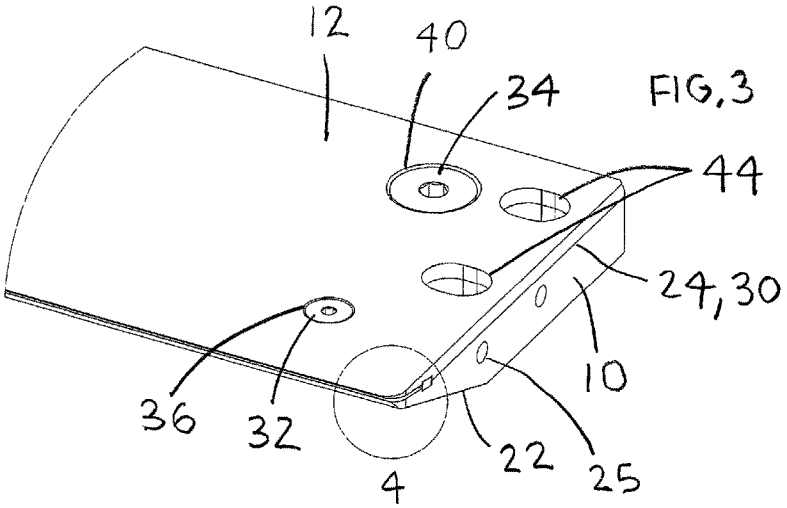
FIG. 3 is an enlarged perspective view of an end of an assembled slicer blade guide of FIG. 2 in accordance with the present invention.
Figure 2:
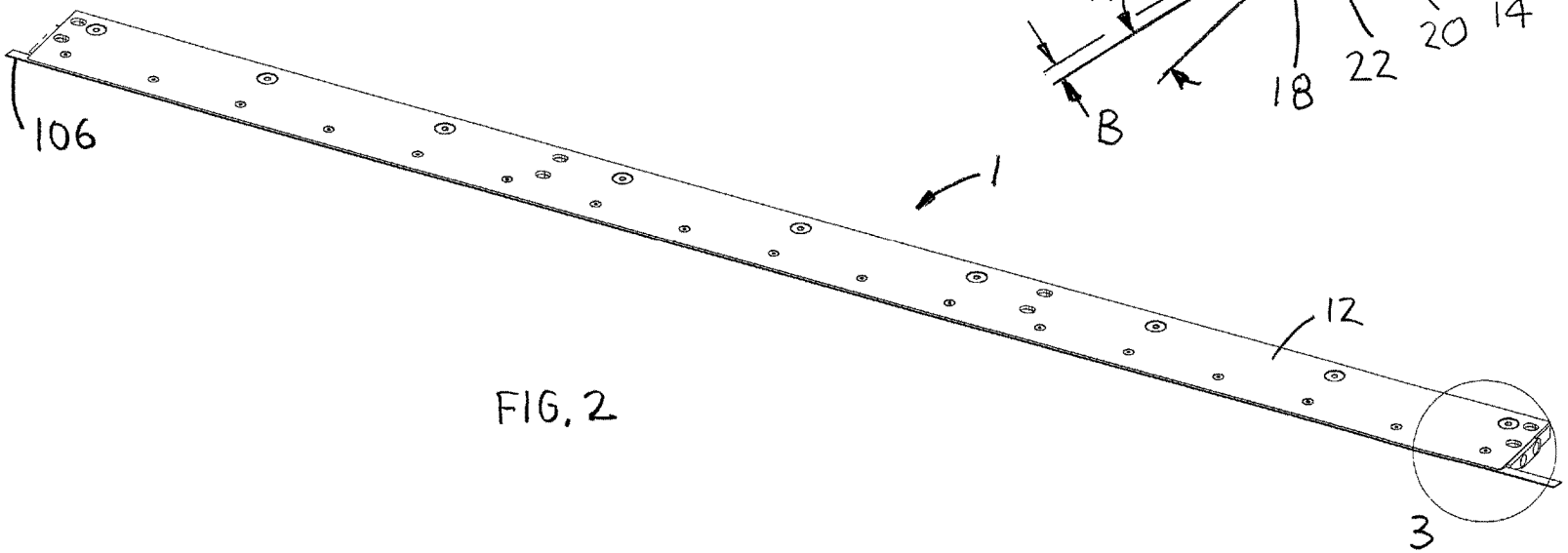
FIG. 2 is a perspective view of an assembled slicer blade guide in accordance with the present invention.
Figure 5:
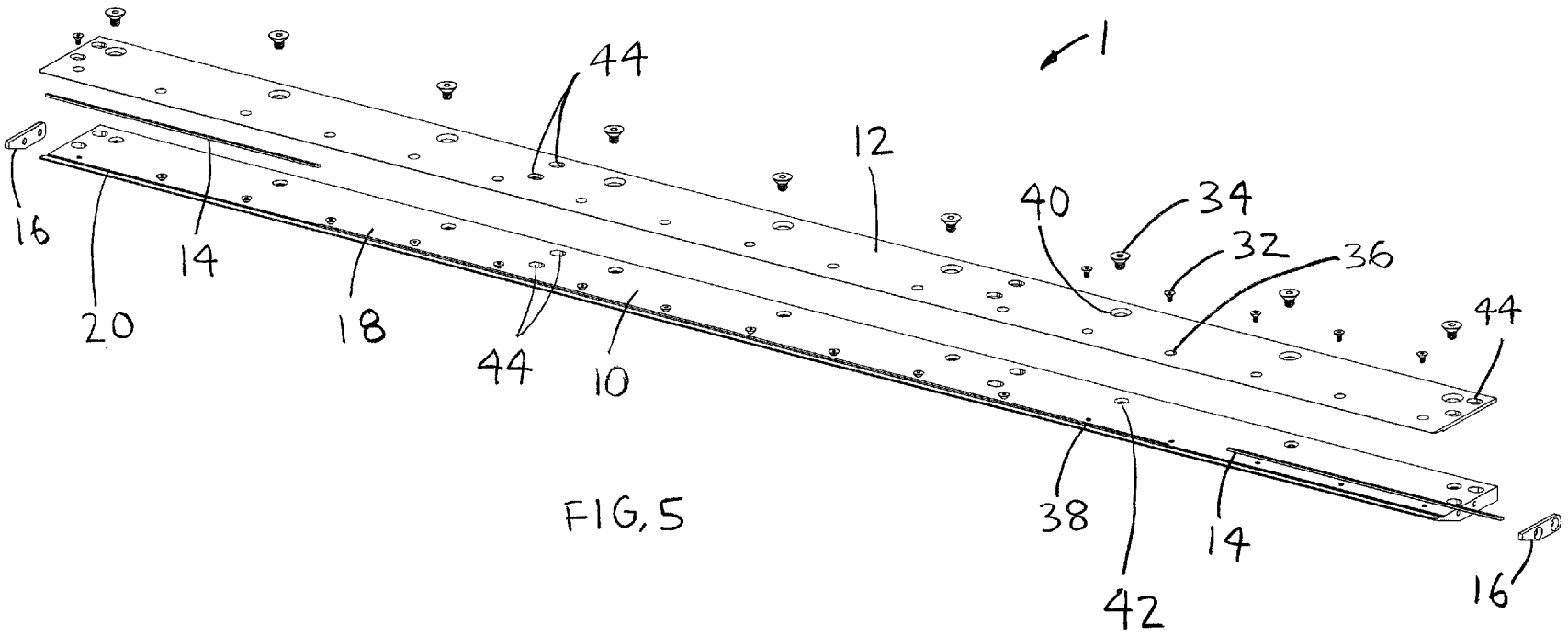
FIG. 5 is a mostly exploded perspective view of a slicer blade guide in accordance with the present invention.

With reference now to the drawings, and particularly to FIG. 2, there is shown a perspective view of a slicer blade guide 1. FIG. 1 shows a portion of a food slicing machine 100 with a slicer blade guide 1 installed in the food slicing machine 100. A plurality of food tubes 102 are positioned above the slicer blade guide 1, which are moved from front to back to slice food items 104 on a continuous cutting blade (cutter blade) 106. The slicer blade guide 1 is attached to a guide support 108 with a plurality of fasteners. With reference to FIGS. 3-5, the slicer blade guide 1 preferably includes a base guide plate 10, an upper guide plate 12, at least one blade insert 14 and a pair end caps 16. The base guide plate 10 preferably includes a base angled blade surface 18, a base insert slot 20 and a bottom chamfered surface 22. The base angled blade surface 18, the base insert slot 20 and the bottom chamfered surface 22 extend across a length of the base guide plate 10. The base angled blade surface 18 extends upward from a top surface 24 of the base guide plate 10 at a front thereof and forms an acute angle "A" with a top surface 24 of the base guide plate 10. Acute angle "A" has a preferable value of 10 degrees, but could have a range of between 5-15 degrees. A bottom of the base insert slot 20 is preferably parallel to the base angled blade surface 18. The base angled blade surface 18 has a width that is less than a width of the slicer blade 106. The base angled blade surface 18 is coated to resist wear from the cutting blade 106. The coating is preferably chrome, but other coatings may also be used. A bottom of the at least one blade insert 14 is retained in the base insert slot 20 and preferably axially retained on each end with the pair end caps 16. The pair of end caps 16 are secured to opposing ends of the base guide plate 10 with a plurality of fasteners (not shown), which are threaded into threaded holes 25. The at least one blade insert 14 is preferably fabricated from carbide, but other hard materials may also be used. The at least one blade insert 14 may be purchased from numerous vendors.

The upper guide plate 12 preferably includes an upper angled blade surface 26 and an upper insert slot 28. The upper angled blade surface 26 and the upper insert slot 28 extend across a length of the upper guide plate 12. The upper angled blade surface 26 extends upward from a bottom surface 30 of the upper guide plate 12 and forms an acute angle "A" therewith. A top of the upper insert slot 28 is parallel to the upper angled blade surface 26. The upper angled blade surface 26 is parallel to the base angled blade surface 18. The base and upper angled blade surfaces 18, 26 have a width, which are less than a width of the cutting blade 106. A cutting edge of the cutting blade 106 must extend beyond the slicer blade guide 1 to cut. The upper angled blade surface 26 is coated to resist wear from the cutting blade 106. The coating is preferably chrome, but other coatings may also be used. A top of the at least one blade insert 14 is retained in the insert slot 28.

The upper guide plate 12 is preferably secured to the base guide plate 10 with a plurality of insert fasteners 32 and a plurality of retention fasteners 34. A plurality of insert countersink holes 36 are formed in the upper guide plate 12 and a plurality insert threaded holes 38 are formed through the base guide plate 10. A plurality of retention countersink holes 40 are formed in the upper guide plate 12 and a plurality insert threaded holes 42 are formed through the base guide plate 10. When the upper guide plate 12 is secured to the base guide plate 10, a distance "B" between the upper angled blade surface 26 and the lower angled blade surface 18 is slightly greater than a thickness of the slicing blade 106. The following dimensions are given by way of example and not by way of limitation. The slicing blade 106 has a typical thickness of about 0.021 inches. The distance "B" is preferably 0.024 inches, but other thicknesses could also be used. A plurality of attachment holes 44 are formed through the base and upper guide plate 10, 12 to secure the slicer blade guide 1 to the guide support 108 with a plurality of fasteners (not shown). The cutting blade 106 asserts most of its force against the at least one blade insert 14. The cutting blade 106 will also exert force on the upper angled blade surface 26 and the lower angled blade surface 18.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A slicer blade guide for use on a food processing machine, the food processing machine including a rotating slicing blade, comprising:

at least one blade insert;

a base guide plate including a base angled blade surface and a base insert slot formed in a top surface of said base guide plate, said base insert slot is sized to receive a bottom of said at least one blade insert; and an upper guide plate including an upper angled blade surface and an upper insert slot formed in a bottom surface of said upper guide plate, said upper insert slot is sized to receive a top of said at least one blade insert, a top surface of said upper insert slot forms an acute angle relative to a bottom surface of said upper guide plate, a bottom surface of said base insert slot forms an acute angle with a top surface of said base guide plate, said bottom surface of said base insert slot and said top surface of said upper insert slot are angled upward, said top surface of said base guide plate and said bottom surface of said upper guide plate mate with each other, said bottom surface of said base insert slot and said top surface of said upper insert slot are parallel to each other, wherein said base angled blade surface and said upper angled blade surface are parallel to said bottom surface of said base insert slot and said top surface of said upper insert slot, respectively and form a front gap between said base angled blade surface and said upper angled blade surface, said front gap sized to receive the slicing blade, said slicer blade guide is configured to be attached to the food processing machine, a non-cutting edge of the slicing blade is supported by and in contact with said at least one insert, said non-cutting edge has a linear motion relative to said at least one insert, wherein said base guide plate is stationary relative to the slicing blade during a cutting operation.

2. The slicer blade guide of claim 1, further comprising:

an end cap is attached to opposing ends of said base guide plate to axially retain said at least one blade insert.

3. The slicer blade guide of claim 1 wherein:

a bottom chamfered surface is formed on a bottom of said base guide plate at a front thereof.

4. The slicer blade guide of claim 3 wherein:

said base insert slot and said bottom chamfered surface extend across a length of said base guide plate.

5. The slicer blade guide of claim 1 wherein:

said upper insert slot extends across a length of said upper guide plate.

6. The slicer blade guide of claim 1, further comprising:

a plurality of fasteners are used to secure said base guide plate to said upper guide plate.

7. A slicer blade guide for use on a food processing machine, the food processing machine including a rotating slicing blade, comprising:

at least one blade insert;

a base guide plate including a base angled blade surface, a base top surface and a base insert slot formed in a top surface of said base guide plate, said base angled blade surface extends upward relative to said base top surface at an acute angle, said base insert slot is sized to receive a bottom of said at least one blade insert; and an upper guide plate including an upper angled blade surface and an upper insert slot, said upper angled blade surface extends upward relative to a bottom surface of said upper guide plate at said acute angle, said upper insert slot is sized to receive a top of said at least one blade insert, said top surface of said base guide plate and said bottom surface of said upper guide plate mate with each other, said base angled blade surface and upper angled blade surface are parallel to each other and extend from said base insert slot and said upper insert slot, respectively to form a front gap between said base angled blade surface and said upper angled blade surface sized to receive the slicing blade, said slicer blade guide is configured to be attached to the food processing machine, a non-cutting edge of the slicing blade is supported by and in contact with said at least one blade insert, said non-cutting edge has a linear motion relative to said at least one blade insert, wherein said base guide plate is stationary relative to the slicing blade during a cutting operation.

8. The slicer blade guide of claim 7, further comprising:

an end cap is attached to opposing ends of said base guide plate to axially retain said at least one blade insert.

9. The slicer blade guide of claim 7 wherein:

a bottom chamfered surface is formed on a bottom of said base guide plate at a front thereof.

10. The slicer blade guide of claim 9 wherein:

said base angled blade surface, said base insert slot and said bottom chamfered surface extend across a length of said base guide plate.

11. The slicer blade guide of claim 7 wherein:

said upper angled blade surface and said upper insert slot extends across a length of said base guide plate.

12. The slicer blade guide of claim 7, further comprising:

a plurality of fasteners are used to secure said base guide plate to said upper guide plate.

13. A method of improving a slicer blade guide for use on a food processing machine, the food processing machine including a rotating slicing blade, comprising the steps of:

providing at least one blade insert;

providing a base guide plate including a base angled blade surface, a base top surface and a base insert slot formed in a top surface of said base guide plate, said base angled blade surface extends upward relative to said base top surface at an acute angle, said base insert slot is sized to receive a bottom of said at least one blade insert; and providing an upper guide plate including an upper insert slot formed in a bottom surface of said upper guide plate, said upper guide slot is sized to receive a top of said at least one blade insert, said top surface of said base guide plate and said bottom surface of said upper guide plate mate with each other, said base angled blade surface and upper angled blade surface are parallel to each other and extend from said base insert slot and said upper insert slot, respectively to form a front gap between said base angled blade surface and said upper angled blade surface, said front gap sized to receive the slicing blade;

attaching said slicer blade guide to the food processing machine;

supporting a non-cutting edge of the slicing blade in contact with said at least one blade insert;

providing linear motion to said non-cutting edge relative to said at least one blade insert; and slicing a food product by said rotating slicing blade, the food product contacting a top of said upper guide plate.

14. The method of improving the slicer blade guide of claim 13, further comprising the step of: attaching an end cap to opposing ends of said base guide plate to axially retain said at least one blade insert.

15. The method of improving the slicer blade guide of claim 13 wherein:

a bottom chamfered surface is formed on a bottom of said base guide plate at a front thereof.

16. The method of improving the slicer blade guide of claim 15 wherein:

said base insert slot and said bottom chamfered surface extend across a length of said base guide plate.

17. The method of improving the slicer blade guide of claim 13 wherein:

said upper insert slot extends across a length of said upper guide plate.

18. The method of improving the slicer blade guide of claim 13, further comprising the step of: providing a plurality of fasteners are used to secure said base guide plate to said upper guide plate.

* * * * *